US006609935B2

(12) United States Patent
Huang

(10) Patent No.: US 6,609,935 B2
(45) Date of Patent: Aug. 26, 2003

(54) USB ELECTRIC FRAGRANT EMITTING JOINT

(76) Inventor: Yea Yen Huang, No. 12, Alley 70, Sec. 1, Chung Hua Road, Tocheng City, Taipei Hsien (TW)

( * ) Notice: Subject to any disclaimer, the term of this patent is extended or adjusted under 35 U.S.C. 154(b) by 0 days.

(21) Appl. No.: 10/020,899

(22) Filed: Dec. 19, 2001

(65) Prior Publication Data

US 2003/0087554 A1 May 8, 2003

(30) Foreign Application Priority Data

Nov. 6, 2001 (TW) ..... 090218952

(51) Int. Cl.[7] ..... H01R 33/945
(52) U.S. Cl. ..... 439/620; 439/131; 392/390
(58) Field of Search ..... 435/620, 131, 435/545, 622; 392/392, 390, 391, 386; 362/276, 226; 424/76.1; 422/174

(56) References Cited

U.S. PATENT DOCUMENTS 6,104,866 A * 8/2000 DeWitt et al. ..... 392/390
6,231,383 B1 * 5/2001 Hwang ..... 439/545
6,315,582 B1 * 11/2001 Nishio et al. ..... 439/131
6,322,395 B1 * 11/2001 Nishio et al. ..... 439/607

* cited by examiner

*Primary Examiner*—Alexander Gilman
(74) *Attorney, Agent, or Firm*—Troxell Law Office PLLC

(57) ABSTRACT

A USB electric fragrant emitting joint comprises an upper casing having emitting holes and USB pattern; a lower casing having a groove at a bottom thereof; a USB connecting terminal being placed in a front end of the upper casing and lower casing; a fragrant rod; an electric heating element. When the USB connecting terminal is inserted into a HUB, it will receive power from the USB so as to generate heat and thus the fragrant rod emit fragrant odor from the emitting holes.

1 Claim, 2 Drawing Sheets

USB ELECTRIC FRAGRANT EMITTING JOINT

BACKGROUND OF THE INVENTION

1. Field of the Invention

The present invention relates to computer peripherals, and particularly to a USB electric fragrant emitting joint.

2. Description of Related Art

More and more computer peripherals, such as keyboards, monitors, mice, printers, scanners, modems, digital cameras, outer boxes, cell phones, are appended to computers. To simplify the connections of the peripherals and the computer, universal serial bus devices are developed, which is used with a hub. Thereby, the peripherals can be inserted into the inserting holes of the hub through the terminals of the USB plug so as to be connected to a power source or related equipment.

The feature of above hub of the USB device is that it has four sub-wires. Two are signal lines and the other two are power wires for supplying low voltages (about 5 V) and low current (about 500 mA). Thereby, the hub may be used as a plug for transferring signals and supplying power.

SUMMARY OF THE INVENTION

Accordingly, the primary object of the present invention is to provide a USB electric fragrant emitting joint. The USB electric fragrant emitting joint of the present invention comprises an upper casing having emitting holes and a USB pattern; a lower casing having a groove at a bottom thereof; a USB connecting terminal placed in front ends of the upper casing and lower casing; a fragrant rod; and an electric heating element. When the USB connecting terminal is inserted into a hub, it will receive power from the USB so as to generate heat and thus the fragrant rod will emit a fragrant odor from the emitting holes.

The various objects and advantages of the present invention will be more readily understood from the following detailed description when read in conjunction with the appended drawing.

DETAILED DESCRIPTION OF THE PREFERRED EMBODIMENTS

Figure 1:
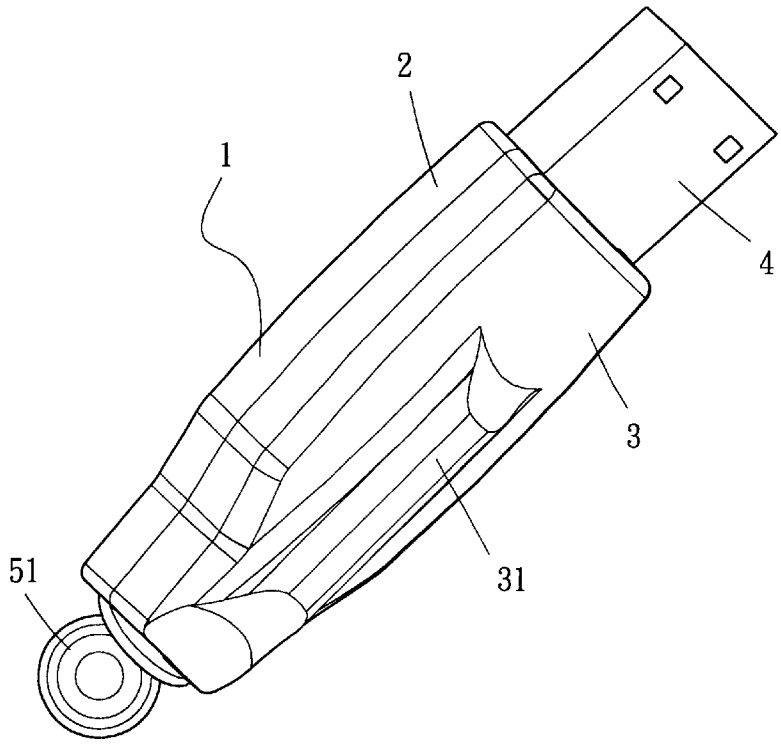
FIG. 1 is a perspective view showing the USB electric fragrant emitting joint of the present invention.
Figure 2:
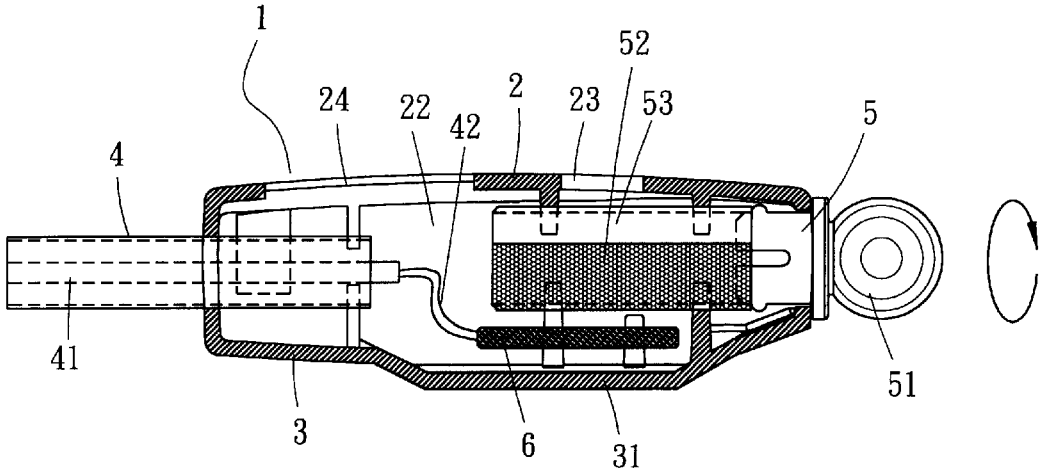
FIG. 2 is a cross sectional view of the USB electric fragrant emitting joint of the present invention.

Referring to FIGS. 1 and 2, the USB electric fragrant emitting joint 1 of the present invention is illustrated. The present invention includes an upper casing 2, a lower casing 3, a USB connecting terminal 4, a rotary fragrant rod 5 and an electric element 6. The upper casing 2 and the lower casing 3 are fastened together by a hook 21. A proper containing space 22 is formed therein. A front end thereof may receive the USB connecting terminal 4 to be fixed therein. One end thereof is extended out of the casing (i.e., a general USB connecting terminal).

The USB connecting terminal 4 has a conductive metal piece 41 for conducting power and signals. Thereby, when the USB connecting terminal 4 is inserted into a hub, it can receive power from the USB. The distal end of the containing space 22 in the USB electric fragrant emitting joint 1 may receive a rotary fragrant rod 5. One end of the rod has a ball shape 51 exposed out of the USB electric fragrant emitting joint 1, and another end thereof has a fragrant absorber 52 for absorbing fragrance material.

Figure 3B:
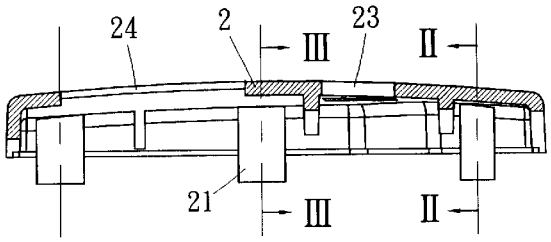
FIGS. 3B–3D are cross sectional views taken along lines I—I, II—II and III—III, respectively.
Figures 3A, 3C, 3D:
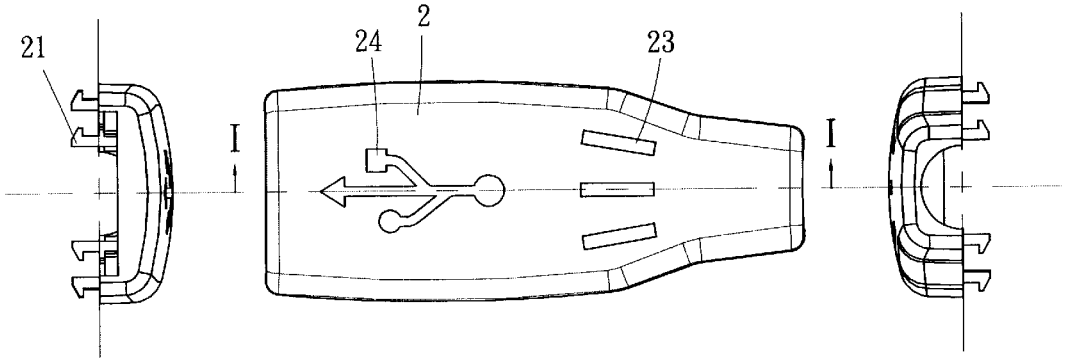
FIG. 3A is a bottom view of the upper casing of the USB electric fragrant emitting joint in the present invention.
Figure 4B:
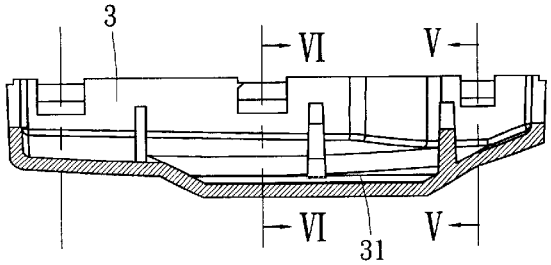
FIGS. 4B–4D are cross sectional views taken along lines IV—IV, V—V and VI—VI, respectively.
Figures 4A, 4C, 4D:
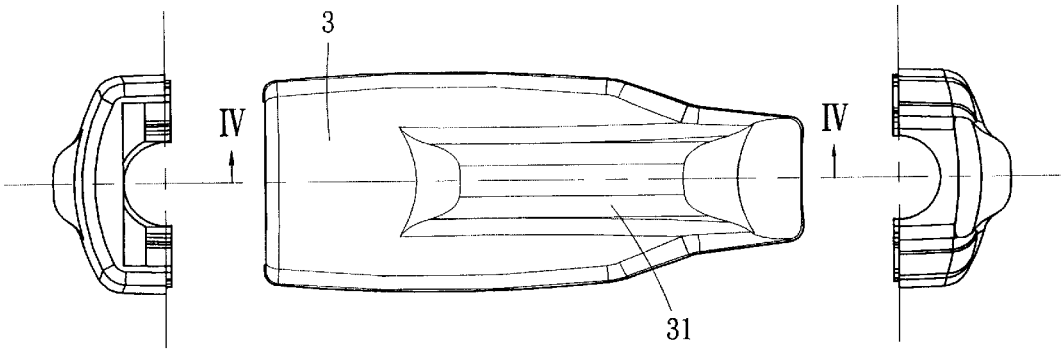
FIG. 4A is a bottom view and the cross sectional view of the lower casing of the USB electric fragrant emitting joint in the present invention.

With reference to FIGS. 3 and 4, the upper casing 2 of the USB electric fragrant emitting joint 1 is formed with emitting holes 23 and USB pattern 24 at positions with respect to the fragrant absorber 52. The USB pattern 24 may be a pattern formed by penetrating holes. A bottom of the lower casing 3 is formed with a groove 31. The groove 31 is fixed with an electric heating element 6 (with a power consumption of 5 V 100$\mu$A ). The power conductive metal piece of the conductive metal piece 41 may be connected to the electric heating element 6 and supply power to the electric heating element 6 so that the electric heating element 6 generates proper heat energy. Thereby, the fragrant absorber 52 is heated and then emits fragrant odor. Then, the fragrant odor emits out through the emitting holes 23.

The fragrant absorber 52 at one end of the rotary fragrant rod 5 has a copper cover 53 at a circumference thereof so that after the rotary fragrant rod 5 rotates through a predetermined angle, the fragrant odor may be emitted out or stop emitting.

The present invention are thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A USB electric fragrant emitting joint comprising:

a) an upper casing having emitting holes and USB pattern formed by penetrating holes;

b) a lower casing having a groove at a bottom thereof, the lower casing being attached to the upper casing by hooks thus forming a containing space;

c) a USB connecting terminal at a front end of the assembled upper and lower casings, and extending out of the assembled casings;

d) a fragrant rod placed in the containing space wherein the fragrant rod is a rotary fragrant rod, a first end of the rod having a ball shape exposed out of the assembled casings, and a second end thereof having a fragrant absorber for absorbing fragrance material, the second end having a copper cover at a circumference thereof so that after the rotary fragrant rod rotates through a predetermined angle, emission of the fragrant odor is controlled; and e) an electric heating element installed in the groove in the lower casing receiving power from the USB connecting terminal so as to generate heat and thus causing the fragrant rod to emit fragrant odor from the emitting holes.

* * * * *